US007242146B2

(12) United States Patent
Sung et al.

(10) Patent No.: US 7,242,146 B2
(45) Date of Patent: Jul. 10, 2007

(54) DRIVING METHOD AND DRIVING APPARATUS

(75) Inventors: Kuang-Feng Sung, Taichung County (TW); Jin-Sheng Hsieh, Taichung (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 11/161,645

(22) Filed: Aug. 11, 2005

(65) Prior Publication Data

US 2006/0152455 A1 Jul. 13, 2006

(30) Foreign Application Priority Data

Jan. 11, 2005 (TW) ..... 94100695 A

(51) Int. Cl.
*G09G 3/10* (2006.01)

(52) U.S. Cl. ..... 315/169.3; 315/169.2; 345/77; 345/212

(58) Field of Classification Search ..... 315/169.1, 315/169.2, 169.3; 345/45, 46, 76, 77, 204, 345/211, 212

See application file for complete search history.

(56) References Cited

U.S. PATENT DOCUMENTS

| | | | | |
|---|---|---|---|---|
| 6,633,136 | B2 * | 10/2003 | Kim et al. | 315/169.3 |
| 6,686,699 | B2 * | 2/2004 | Yumoto | 315/169.3 |
| 6,870,553 | B2 * | 3/2005 | Kondo et al. | 345/690 |
| 6,958,742 | B2 * | 10/2005 | Date et al. | 345/90 |
| 7,015,882 | B2 * | 3/2006 | Yumoto | 345/76 |
| 7,091,938 | B2 * | 8/2006 | Inukai et al. | 345/76 |
| 2003/0058199 | A1 * | 3/2003 | Kasai | 345/76 |

* cited by examiner

*Primary Examiner*—Douglas W. Owens
*Assistant Examiner*—Jimmy Vu
(74) *Attorney, Agent, or Firm*—Jianq Chyun IP Office

(57) ABSTRACT

A driving apparatus for driving a plurality of display devices of a panel is provided. The driving apparatus comprises a controllable current source and a plurality of current storage and duplicating apparatuses. Wherein, each of the current storage and duplicating apparatuses is coupled to the controllable current source and one of the display devices corresponding thereto to receive a first current from the controllable current source, and to output a second current which is equal, or proportional to the first current to drive the display apparatus.

13 Claims, 9 Drawing Sheets

400

900

DRIVING METHOD AND DRIVING APPARATUS

CROSS-REFERENCE TO RELATED APPLICATION

This application claims the priority benefit of Taiwan application Ser. No. 94100695, filed on Jan. 11, 2005. All disclosure of the Taiwan application is incorporated herein by reference.

BACKGROUND OF THE INVENTION

1. Field of the Invention

The present invention relates to a driving apparatus and a driving method of a display device, and more particularly, to a driving apparatus with a current storage and duplicating apparatus and a driving method thereof.

2. Description of the Related Art

Traditionally, an organic light-emitting diode (OLED) comprises an organic thin film between its transparent anode and metal cathode. With these film layers, electrons and holes combine in the organic thin film to release energy which converts into visible light. In addition, different organic materials can generate different color lights. By using different organic materials, a full-color display can be manufactured. Generally, advantages of an OLED display include: self-illumination, slim structure, high brightness, high fluorescence efficiency, high contrast, low response time (e.g., in a few microseconds), wide view angle, low power consumption, wide temperature range, and panel flexibility.

Generally, the organic light-emitting diode may be driven by using current for illumination. The amount of currents will determine brightness and color of the OLED. Accordingly, each light-emitting diode needs a driving circuit for controlling the current. The traditional method of controlling the current can be achieved by using switches to control the number of the functioning transistors in a current mirror. For example, a current-type digital-to-analog converter (DAC) uses this method.

FIG. 1 is a schematic drawing showing a prior art OLED display. Referring to FIG. 1, the prior art OLED display 100 comprises a panel 102 and a driving circuit 104. The panel 102 comprises a plurality of matrix-arranged OLEDs 112. The driving circuit 104 comprises a plurality of controllable current sources 114, wherein, each controllable current source 114 is coupled to a corresponding OLED 112. The controllable current source 114 outputs a current to drive the OLED 112 coupled thereto for illumination. The amount of the current determines the brightness and color of the OLED. Accordingly, each OLED 112 requires a controllable current source 114 in the traditional technology.

As described, since each OLED requires a controllable current source, the prior art driving circuit 104 needs a huge area and is costly. In addition, the error of the manufacturing process of the controllable current source also causes high current errors output from it. It is thus desired to develop a method and an apparatus which can reduce the area and cost of the driving circuit, eliminate the current error resulting from the manufacturing process error of the controllable current source, and increase the display efficiency and uniformity of the OLED.

SUMMARY OF THE INVENTION

Accordingly, the present invention is directed to a driving apparatus which reduces the area and cost of the driving apparatus. The driving apparatus further prevents brightness errors occurred due to each OLED using a different controllable current source in the prior art technology.

In addition, the present invention is also directed to a driving method to reduce the area and cost of the driving apparatus. The driving method completely prevents brightness errors occurred due to each OLED using a different controllable current source in the prior art technology.

The driving apparatus of the present invention drives a plurality of display devices of a panel. The driving apparatus comprises a controllable current source and a plurality of current storage and duplicating apparatuses. Wherein, each of the current and duplicating apparatuses is coupled to the controllable current source and a display device to receive a first current from the controllable current source, and to output a second current which is equal, or proportional, to the first current to drive the display device.

According to an embodiment of the present invention, each of the current storage and duplicating apparatuses comprises: a first switch, a second switch, a third switch, a transistor, and a capacitor. Wherein, a terminal of the first switch is coupled to the controllable current source, and another terminal of the first switch is coupled to a terminal of the second switch, a terminal of the third switch, and a drain of the transistor, another terminal of the second switch is coupled to a gate of the transistor, and another terminal of the third switch is coupled to the display device.

According to an embodiment of the present invention, each of the current storage and duplicating apparatuses comprises: a first switch, a second switch, a first transistor, a second transistor, a capacitor, and a capacitor. Wherein, a terminal of the first switch is coupled to the controllable current source, another terminal of the first switch is coupled to a gate of the first transistor, a gate and a drain of the second transistor, and the capacitor. In addition, a terminal of the second switch is coupled to the display device, and another terminal of the second switch is coupled to a drain of the first transistor.

According to an embodiment of the present invention, the driving apparatus further comprises a first transistor, and a drain of the first transistor is coupled to a gate of the first transistor and the controllable current source. Each of the current storage and duplicating apparatuses comprises a first switch, a second switch, a second transistor, and a capacitor. Wherein, a terminal of the first switch is coupled to a gate of the first transistor, another terminal of the first switch is coupled to a gate of the second transistor and the capacitor, a terminal of the second switch is coupled to the display device, and another terminal of the second switch is coupled to the drain of the second transistor.

According to an embodiment of the present invention, the display device comprises an LED or an OLED.

According to an embodiment of the present invention, the controllable current source comprises: a constant current source; a first transistor, wherein a gate and a drain of the first transistor are coupled to the constant current source; a current mirror apparatus comprising a plurality of second transistors. In addition, a gate of each of the second transistors is coupled to the gate of the first transistor; and a plurality of switches. Wherein, a terminal of each of the switches is individually coupled to a drain of one of the second transistors, and another terminal of each of the switches is coupled to an output terminal.

The driving method of the present invention is adapted for a driving apparatus to drive a plurality of display devices of a panel. The driving apparatus comprises a controllable current source and a plurality of current storage and duplicating apparatuses. Wherein, each of the current storage and duplicating apparatuses is individually coupled to the controllable current source and one of the display devices. The driving method comprises: each of the current storage and duplicating apparatuses individually receiving a first current from the controllable current source, and outputting a second current which is equal, or proportional to the first current to drive each of the display devices.

According to an embodiment of the present invention, each of the current storage and duplicating apparatuses individually executes a current storage function during one of a plurality of time sequences, and executes a function of driving one of the display devices corresponding thereto during a time sequence different from the time sequences of executing the current storage function, or executes a function of driving all the display devices on a same time sequence different from the time sequences of executing the current storage function.

According to an embodiment of the present invention, each of the current storage and duplicating apparatuses individually executes a current storage function during one of a plurality of time sequences, and executes a function of driving all of the display devices after all of the current storage and duplicating apparatuses have completed the execution of current storage function.

According to an embodiment of the present invention, each of the current storage and duplicating apparatuses comprises a first switch, a second switch, a third switch, a transistor, and a capacitor. Wherein, a terminal of the first switch is coupled to the controllable current source, another terminal of the first switch is coupled to a terminal of the second switch, a terminal of the third switch, and a drain of the transistor, another terminal of the second switch is coupled to a gate of the transistor, and another terminal of the third switch is coupled to the display device. The driving method includes: when a first current source storage and duplicating apparatus of the current storage and duplicating apparatuses executes the current storage function, the controllable current source generates a first current, the first switch and the second switch of the first current source storage and duplicating apparatus are turned on, and a voltage difference of a gate to a source of the transistor is stored in the capacitor. The third switch is then turned on; when the first current source storage and duplicating apparatus executes the driving function, and the transistor generates a second current equal to the first current.

According to an embodiment of the present invention, each of the current storage and duplicating apparatuses comprises a first switch, a second switch, a first transistor, a second transistor, and a capacitor. Wherein, a terminal of the first switch is coupled to the controllable current source, another terminal of the first switch is coupled to a gate of the first transistor, a gate and a drain of the second transistor, and the capacitor, a terminal of the second switch is coupled to the display device, and another terminal of the second switch is coupled to a drain of the first transistor. The driving method includes: when a first current source storage and duplicating apparatus of the current storage and duplicating apparatuses executes the current storage function, the controllable current source generates a first current, the first switch of the first current source storage and duplicating apparatus is turned on, and a voltage difference of a gate to a source of the second transistor is stored in the capacitor. The second switch is then turned on; when the first current source storage and duplicating apparatus executes the driving function, and the first transistor generates a second current proportional to the first current, wherein a ratio of the second current to the first current is equal to a ratio of an aspect ratio of the second transistor to an aspect ratio of the first transistor. Additionally, in another embodiment of the present invention, the driving method further comprises turning on the second switches during any of the time sequences. The current storage function of the current storage and duplicating apparatuses, and the driving function of OLEDs corresponding thereto are simultaneously executed.

According to an embodiment of the present invention, the driving apparatus further comprises a first transistor, a drain of the first transistor is coupled to a gate of the first transistor and the controllable current source, each of the current storage and duplicating apparatuses comprises a first switch; a second switch; a second transistor; and a capacitor. Wherein, a terminal of the first switch is coupled to a gate of the first transistor, another terminal of the first switch is coupled to a gate of the second transistor and the capacitor, a terminal of the second switch is coupled to the display device, and another terminal of the second switch is coupled to the drain of the second transistor. In the driving method, when a first current source storage and duplicating apparatus of the current storage and duplicating apparatuses executes the current storage function, the controllable current source generates a first current, the first switch of the first current source storage and duplicating apparatus is turned on, and a voltage difference of a gate to a source of the first transistor is stored in the capacitor. The second switch is then turned on; when the first current source storage and duplicating apparatus executes the driving function, and the first transistor generates a second current proportional to the first current, wherein a ratio of the second current to the first current is equal to a ratio of an aspect ratio of the second transistor to an aspect ratio of the first transistor. Additionally, in another embodiment of the present invention, the driving method further comprises turning on the second switches during any of the time sequences. The current storage function of the current storage and duplicating apparatuses, and the driving function of OLEDs corresponding thereto are simultaneously executed.

According to an embodiment of the present invention, the display device comprises an LED or an OLED.

Accordingly, each organic light-emitting diode over the panel corresponds to a current storage and duplicating apparatus. Thus only one controllable current source of the driving apparatus is required. The amount of the controllable current sources can be effectively reduced. The advantages of the present invention at least comprises reducing the area and cost of the whole driving apparatus, and eliminating brightness errors due to the reason that each of OLEDs uses a controllable current source different from each other in the prior art technology.

The above and other features of the present invention will be better understood from the following detailed description of the preferred embodiments of the invention that is provided in communication with the accompanying drawings.

DESCRIPTION OF SOME EMBODIMENTS

Figure 1:
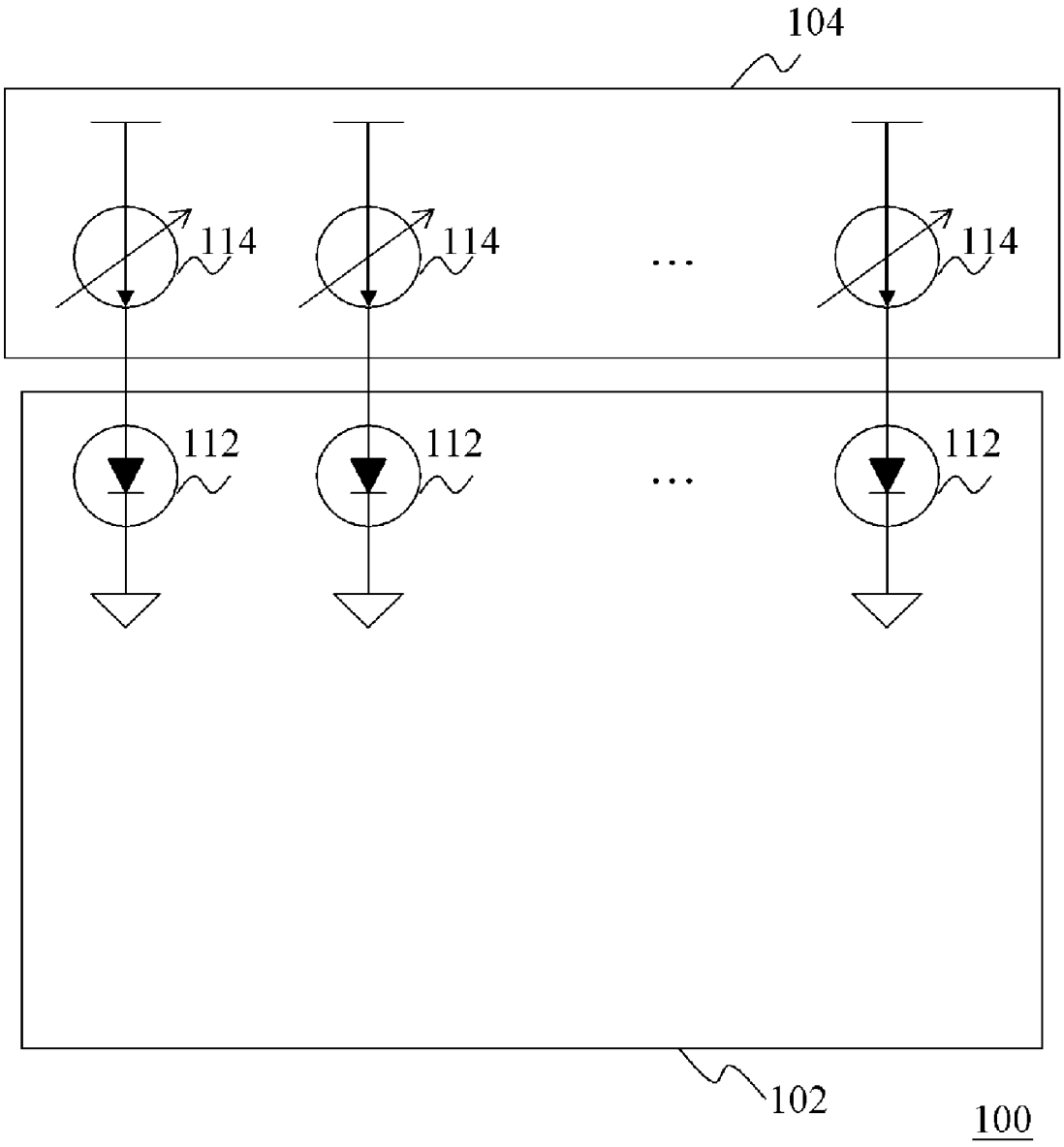
FIG.1 (PRIOR ART)
FIG. 1 is a schematic drawing showing a prior art OLED display.
Figure 2:
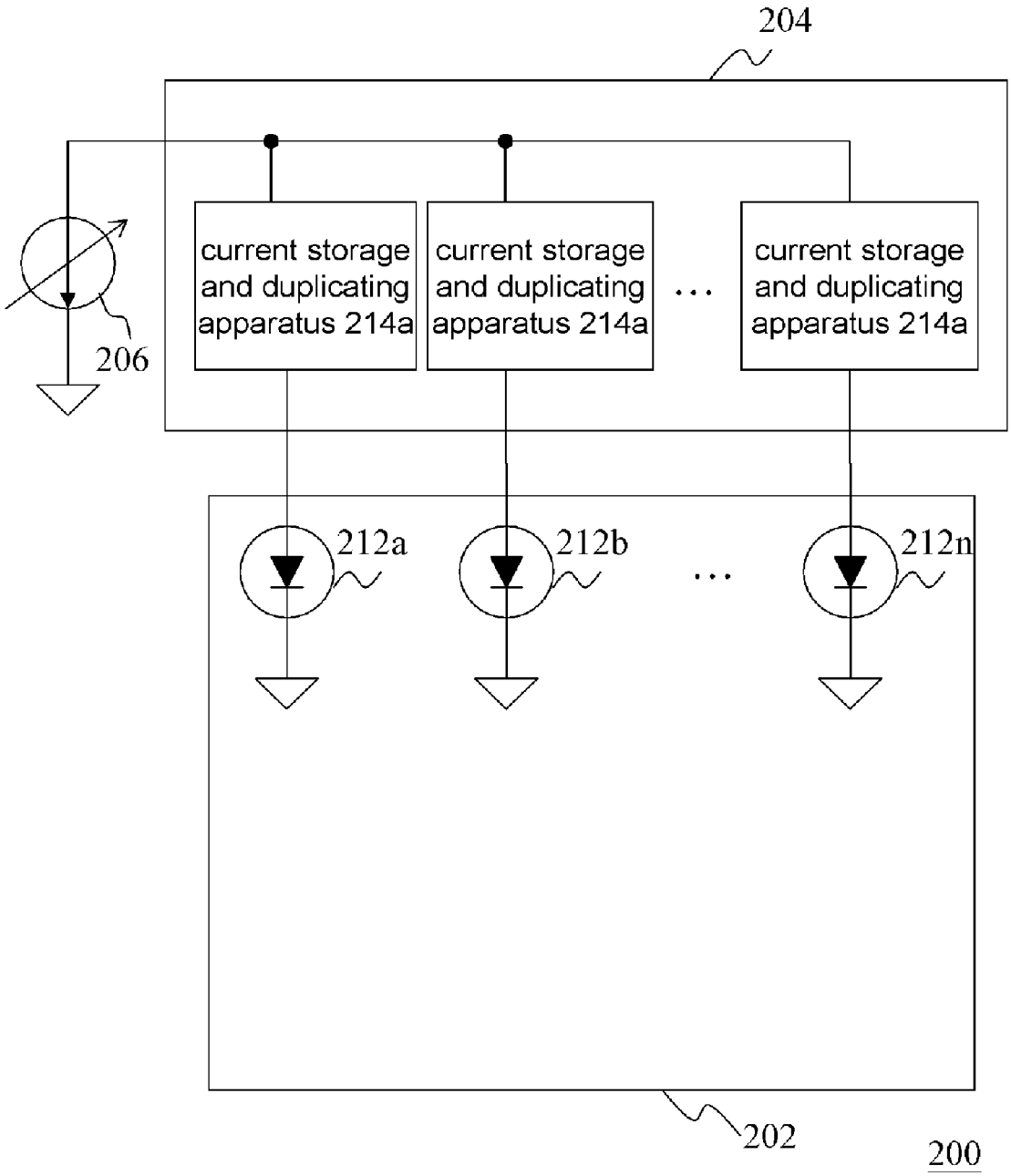
FIG. 2 is a schematic drawing showing an OLED display according to an embodiment of the present invention.

FIG. 2 is a schematic drawing showing an OLED display according to an embodiment of the present invention. Referring to FIG. 2, the OLED display 200 comprises, for example, a panel 202 and a driving apparatus 204. The panel comprises, for example, a plurality of OLEDs 212*a*–212*n*. These OLEDs 212*a*–212*n* can be arranged in an array or in a Δshape. The driving apparatus 204 comprises a controllable current source 206 and a plurality of current storage and duplicating apparatuses 214*a*–214*n* coupled to the controllable current source 206. The current storage and duplicating apparatuses 214*a*–214*n* are coupled to the OLEDs 212*a*–212*n*, respectively. The current storage and duplicating apparatuses 214*a*–214*n* individually output currents to drive the OLEDs 212*a*–212*n* coupled thereto to make them illuminate, respectively. The amount of these currents determines brightness and colors of the OLEDs 212*a*–212*n*.

Figure 3:
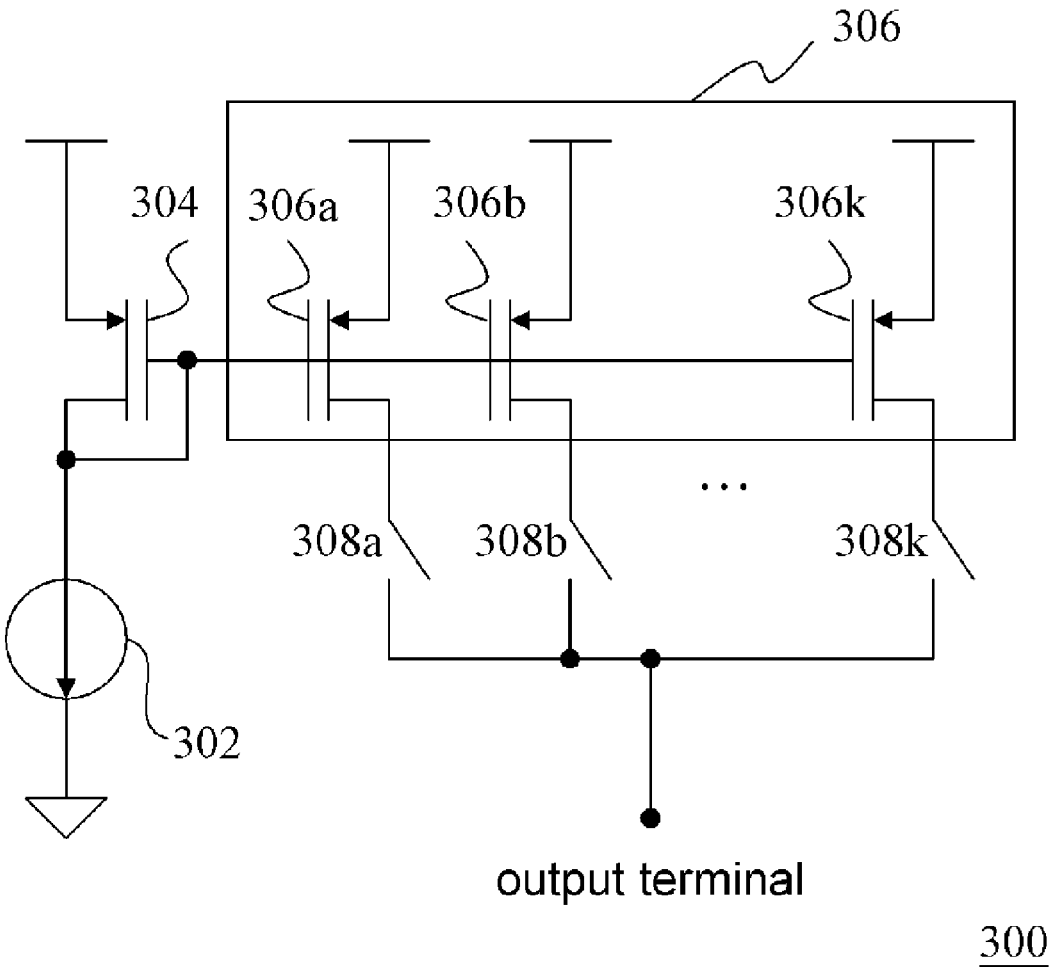
FIG. 3 is a schematic drawing showing a controllable current source according to an embodiment of the present invention.

FIG. 3 is a schematic drawing showing a controllable current source according to an embodiment of the present invention. Referring to FIG. 3, the described controllable current source 206 can include the controllable current source 300, for example. The controllable current source 300 comprises, for example, a constant current source 302, a transistor 304, a current mirror apparatus 306 and a plurality of switches 308*a*–308*k*. The current mirror apparatus 306 comprises a plurality of transistors 306*a*–306*k*. Gates of the transistors 306*a*–306*k* are coupled to the gate of the transistor 304. Drains of the transistors 306*a*–306*k* are individually coupled to the switches 308*a*–308*k* corresponding thereto, respectively. The gate and the drain of the transistor 304 are coupled to the constant current source 302. In FIG. 3, the controllable current source 300 has k sections of adjustable resolutions. Wherein, each of the transistors 306*a*–306*k* has an equivalent aspect ratio. The constant current source 302 outputs a constant current. The constant current flows through the transistor 304 to control turn-on or turn-off of the switches 308*a*–308*k* so as to determine the output currents of the output terminal. The output currents are then input to all current storage and duplicating apparatuses 214*a*–214*n* in FIG. 2.

Figure 4:
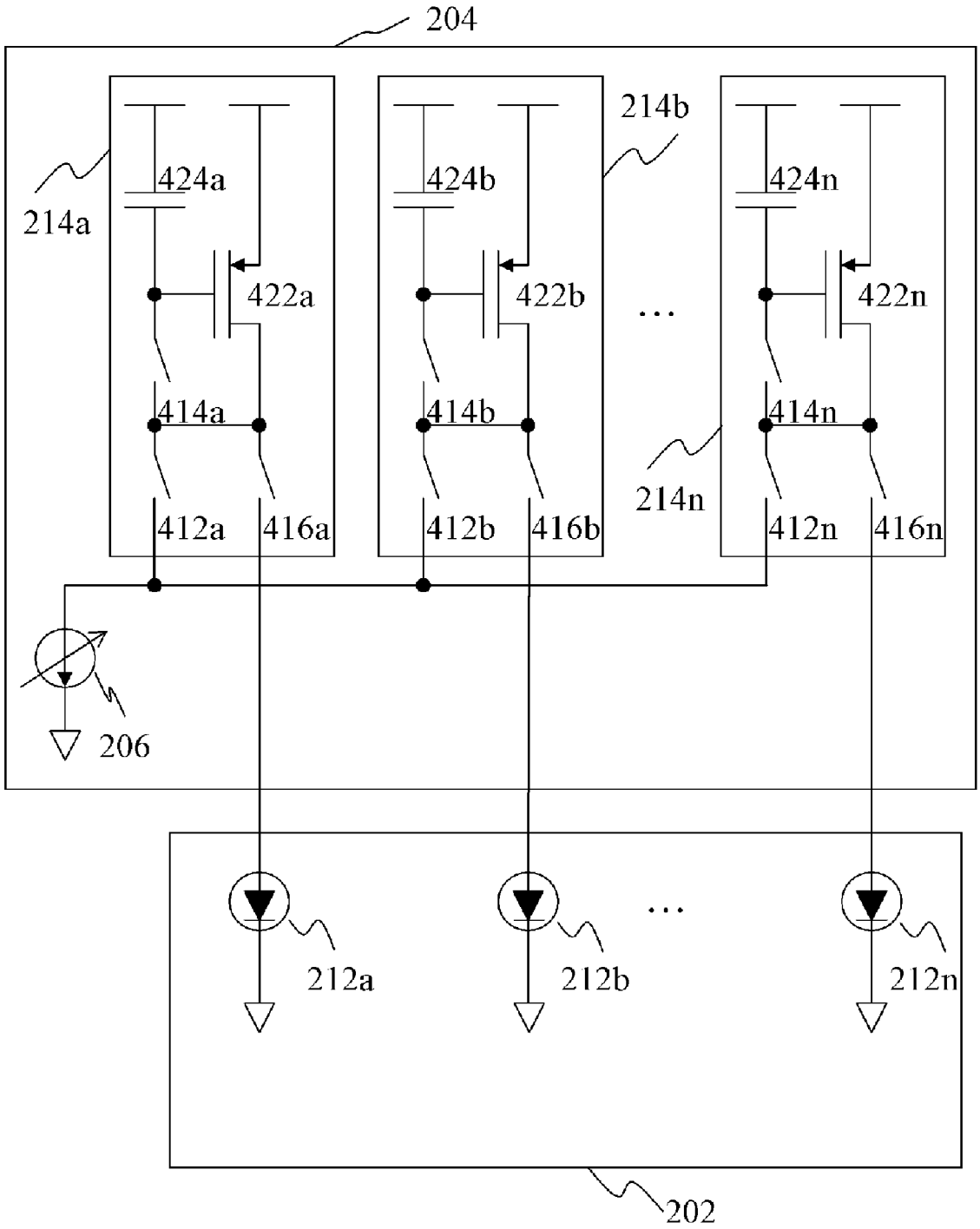
FIG. 4 is a schematic drawing showing a driving apparatus for an OLED display according to an embodiment of the present invention.

FIG. 4 is a schematic drawing showing a driving apparatus for an OLED display according to an embodiment of the present invention. The OLED display 400 in FIG. 4 is similar to the OLED display 200 in FIG. 2. The difference between them is in the structure of the current storage and duplicating apparatuses 214*a*–214*n*. In FIG. 4, the current storage and duplicating apparatus 214*a* comprises, for example, switches 412*a*, 414*a*, and 416*a;* a transistor 422*a*, and a capacitor 424*a*. Wherein, a terminal of the switch 412*a* is coupled to the controllable current source 206, and another terminal of the switch 412*a* is coupled to a terminal of the switch 414*a*, a terminal of the switch 416*a*, and the drain of the transistor 422*a*. Another terminal of the switch 414*a* is coupled to the capacitor 424*a*, and the gate of the transistor 422*a*. Another terminal of the switch 416*a* is coupled to the OLED 212*a*. In addition, the structure of the current storage and duplicating apparatuses 214*b*–214*n* is similar to or same as that of the current storage and duplicating apparatus 214*a*.

Referring to FIG. 4, in an embodiment of the present invention, when the current storage and duplicating apparatus 214*a* executes the current storage function, the controllable current source 206 generates a first current for the OLED 212*a*. The switches 412*a* and 414*a* are turned on. The first current then flows from the source of the transistor 422*a* to the controllable current source 206 through the switches 412*a* and 414*a*. The transistor 422*a*, corresponding to the current of the controllable current source 206, generates a voltage difference Vgs of the gate to the source. The voltage difference is then stored in the capacitor 424*a*. The current storage and duplicating apparatus 214*a* thus finishes the current storage function.

Referring to FIG. 4, in an embodiment of the present invention, the current storage and duplicating apparatus 214*a* executes the driving function. Because the capacitor 424*a* stores the voltage difference Vgs of the gate to the source of the transistor 422*a*, the current output from the transistor 422*a* is equal to the first current desired for the OLED 212*a* when the switch 416*a* is turned on.

Figure 5:
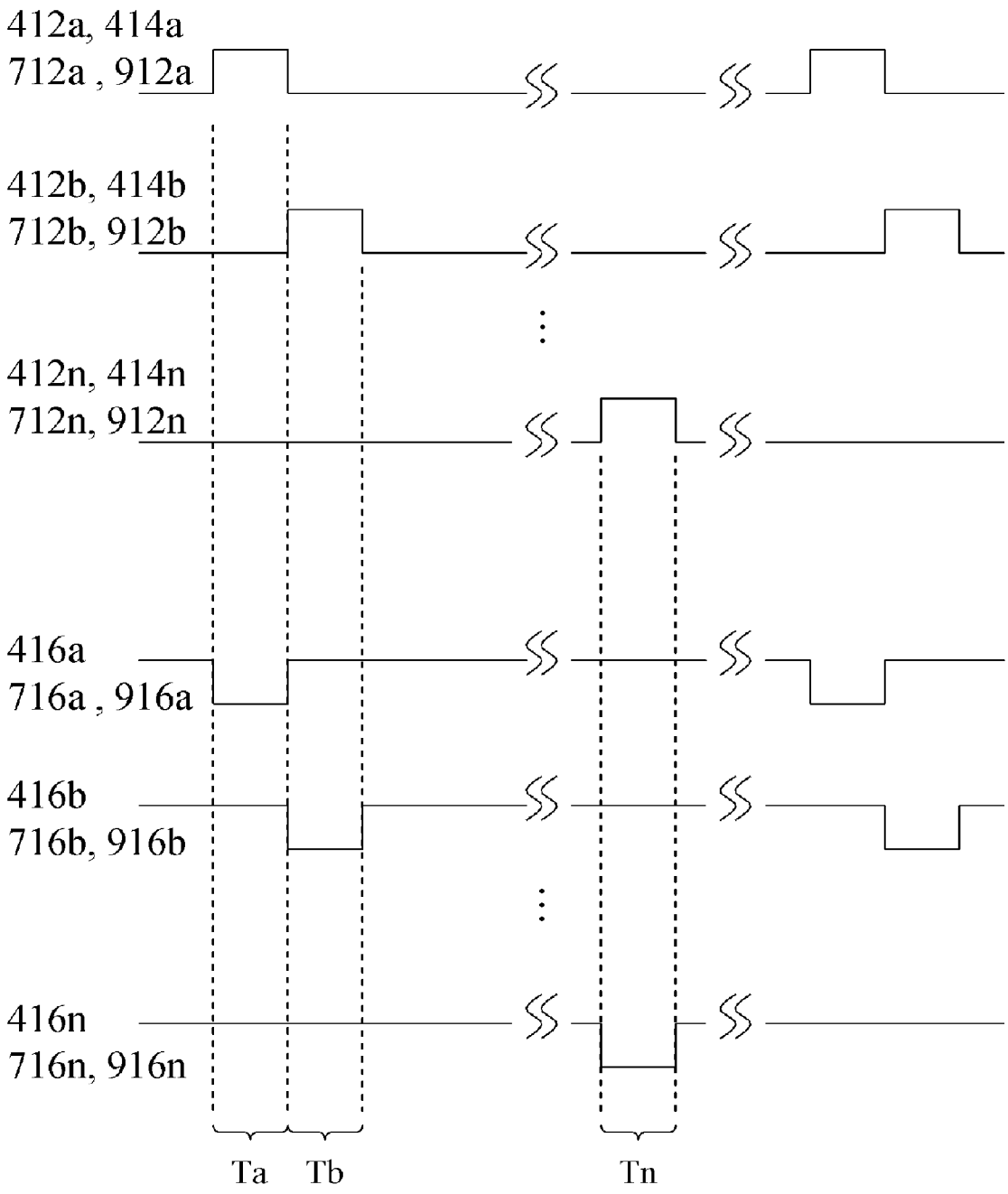
FIG. 5 is a schematic drawing showing driving sequences of an OLED display according to an embodiment of the present invention.

FIG. 5 is a schematic drawing showing driving sequences of an OLED display according to an embodiment of the present invention. Referring to FIG. 5, all switches are turned on in high voltages and turned off in low voltages. First, during the time period Ta, the switches 412*a* and 414*a* are turned on, the voltage difference Vgs of the gate to the source of the transistor 422*a* is stored in the capacitor 424*a*, and the switch 416*a* is turned off. During the time period Tb, the switches 412*b* and 414*b* are turned on, the voltage difference Vgs of the gate to the source of the transistor 422*b* is stored in the capacitor 424*b*, and the switch 416*b* is turned off. Note that except during the time period Ta, the switches 412*a* and 414*a* are turned off, and the switch 416*a* is turned on, and the OLED 212*a* is driven by the desired current. Accordingly, the current storage and duplicating apparatuses 214*a*–214*n* execute the current storage function during the time periods Ta, Tb–Tn, respectively. During other time periods, the current storage and duplicating apparatuses 214*a*–214*n* execute the driving function of the OLEDs 212*a*–212*n* corresponding thereto, respectively.

Figure 6:
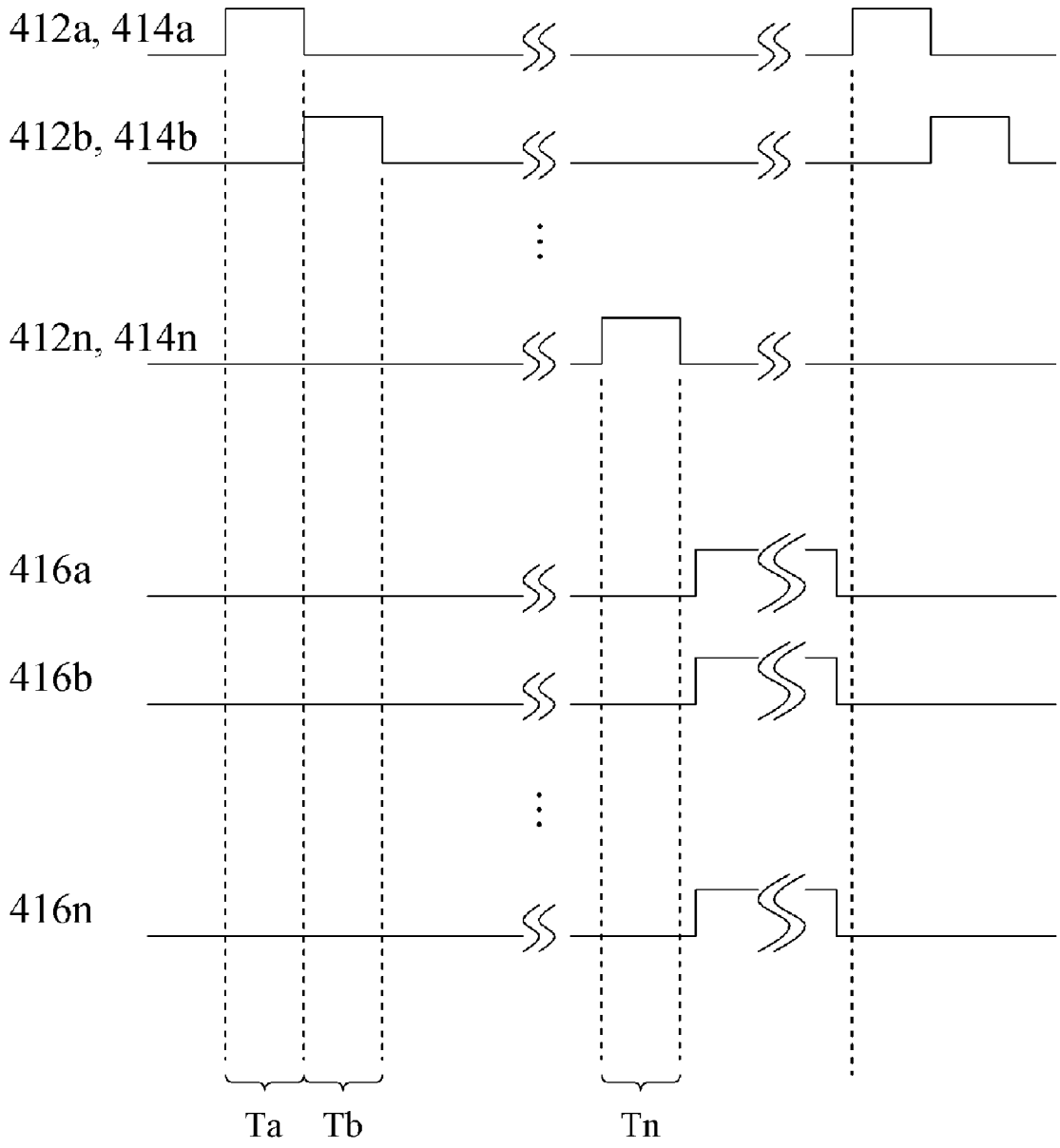
FIG. 6 is a schematic drawing showing driving sequences of an OLED display according to another embodiment of the present invention.

FIG. 6 is a schematic drawing showing driving sequences of an OLED display according to another embodiment of the present invention. Referring to FIG. 6, all switches are turned on in high voltages and turned off in low voltages. What is different is that the current storage and duplicating apparatuses 214*b*–214*n* execute the current storage function during the time periods Ta, Tb–Tn, respectively. After finishing the current storage function, all of the switches 416*a*–416*n* are turned on to execute the driving function of the OLEDs 212*a*–212*n*.

Referring to FIG. 2 or 4, in this invention only one controllable current source 206 is required. The amount of the controllable current sources can be effectively reduced. The advantages include not only effectively reducing the area and cost of the driving apparatus 204, but since only one controllable current source 206 is used, it also completely prevents the brightness errors occurred because of the reason that each of OLEDs uses a different controllable current source in the prior art technology.

Figure 7:
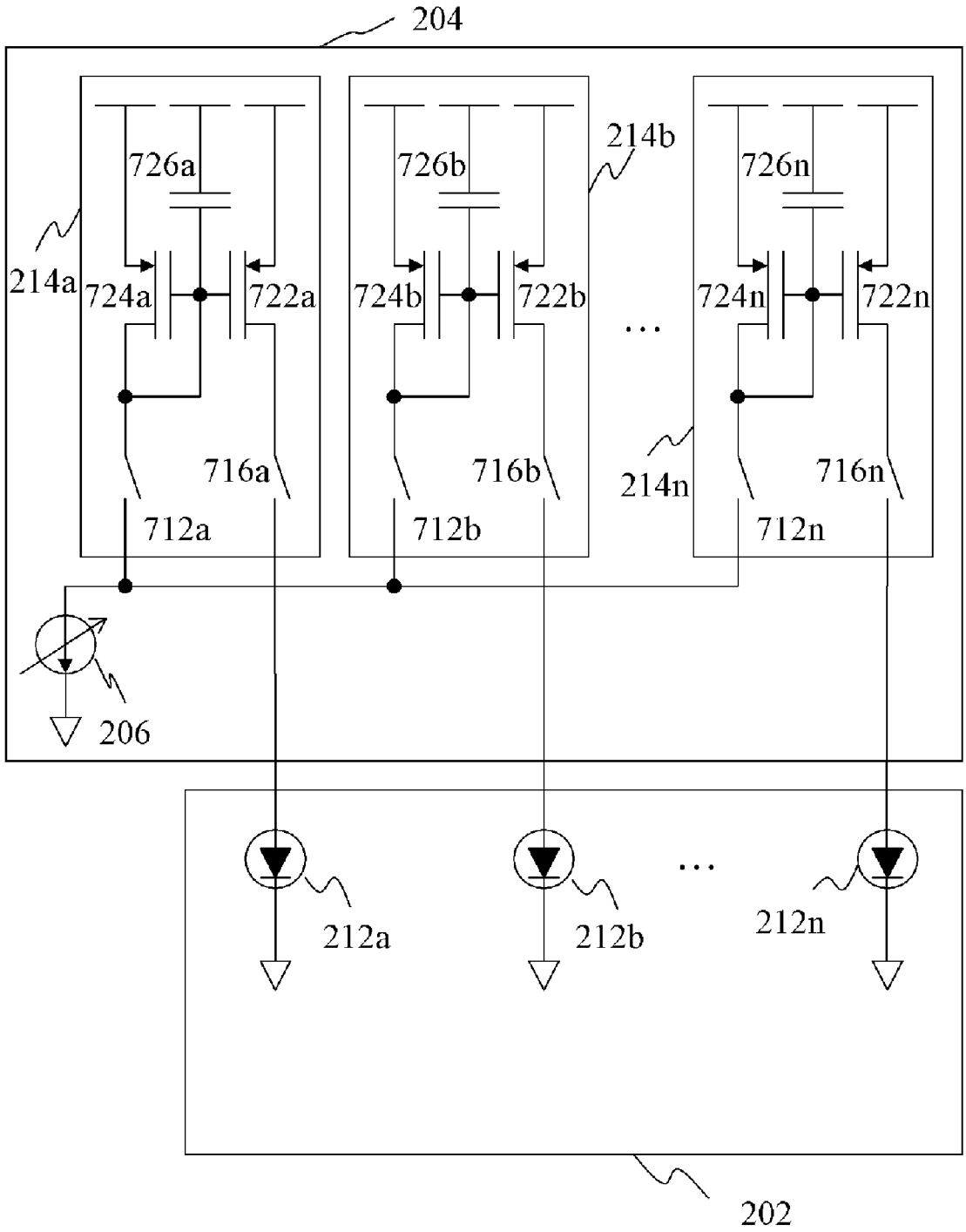
FIG. 7 is a schematic drawing showing a driving apparatus of an OLED according to another embodiment of the present invention.

FIG. 7 is a schematic drawing showing a driving apparatus of an OLED display according to another embodiment of the present invention. The OLED display 700 in FIG. 7 is similar to the OLED display 200 in FIG. 2. What is different is in the structure of the current storage and duplicating apparatuses 214*a*–214*n*. In FIG. 7, the current storage and duplicating apparatus 214*a* comprises, for example, switches 712*a* and 716*a;* transistors 722*a* and 724*a*, and a capacitor 724*a*. Wherein, a terminal of the switch 712*a* is coupled to the controllable current source 206, and another terminal of the switch 712*a* is coupled to the gate of the transistor 722*a*, the gate and the drain of the transistor 724*a*, and the capacitor 726*a*. A terminal of the switch 714*a* is coupled to the OLED 212*a*. Another terminal of the switch 714*a* is coupled to the drain of the transistor 722*a*. In addition, the structure of the current storage and duplicating apparatuses 214*b*–214*n* is similar or the same to that of the current storage and duplicating apparatus 214*a.*

Referring to FIG. 7, in an embodiment of the present invention, when the current storage and duplicating apparatus 214*a* executes the current storage function, the controllable current source 206 generates a first current for the OLED 212*a*. The switch 712*a* is turned on. The first current then flows from the source of the transistor 724*a* to the controllable current source 206 through the switch 712*a*. The transistor 722*a,* corresponding to the current of the controllable current source 206, generates a voltage difference Vgs of the gate to the source. The voltage difference is then stored in the capacitor 726*a*. The current storage and duplicating apparatus 214*a* thus finishes the current storage function.

Referring to FIG. 7, in an embodiment of the present invention, the current storage and duplicating apparatus 214*a* executes the driving function, and the aspect ratio of the transistor 722*a* is M times of that of the transistor 724*a*. When the voltage difference Vgs of the gate to the source of the transistor 724*a* is stored in the capacitor 726*a*, once the switch 716*a* is turned on, the current output from the transistor 422*a* is M times of the first current.

Referring to FIG. 5, all switches are turned on in high voltages and turned off in low voltages. Waveforms of the switches 712*a*, 712*b*–712*n*, and 716*a*, 716*b*–716*n* are shown in FIG. 5. The current storage and duplicating apparatuses 714*a*–714*n* execute the current storage function during the time periods Ta–Tn, respectively. During other time periods, the current storage and duplicating apparatuses 714*a*–714*n* execute the driving function of the organic light-emitting diodes 212*a*–212*n* corresponding thereto, respectively.

Figure 8:
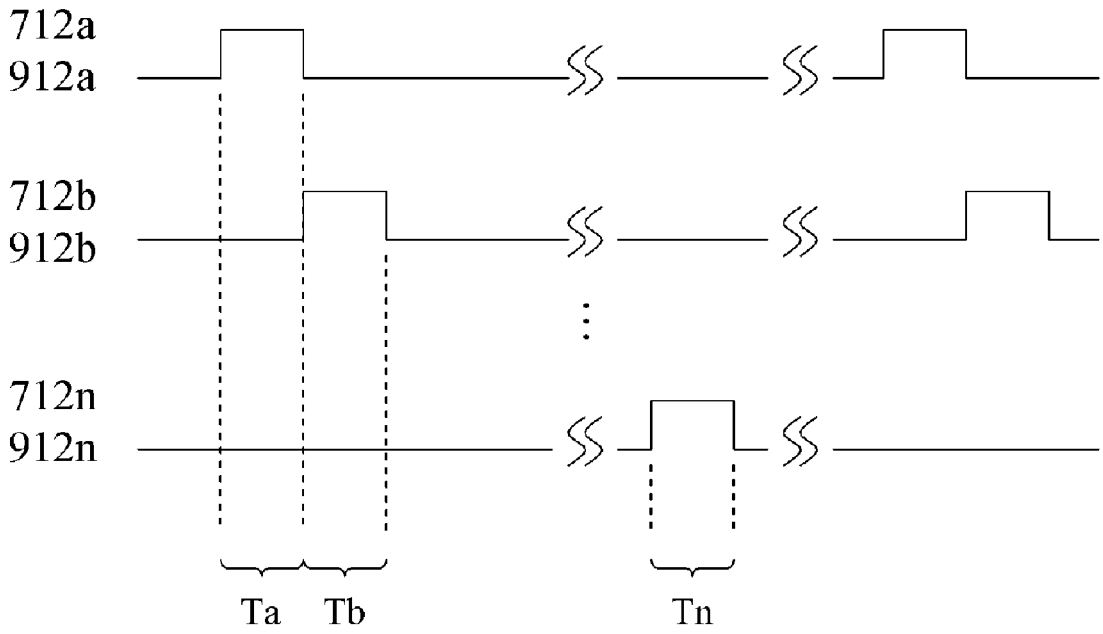
FIG. 8 is a schematic drawing showing driving sequences of an OLED according to another embodiment of the present invention.

FIG. 8 is a schematic drawing showing driving sequences of an OLED display according to another embodiment of the present invention. Referring to FIGS. 7 and 8, in an embodiment of the present invention, all of the switches 716*a*–716*n* are turned on during any time period. As a result, the current storage function of the current storage and duplicating apparatuses 214*a*, 214*b*–214*n*, and the driving function of the OLEDs 212*a*–212*n* corresponding thereto are simultaneously executed. As shown in FIG. 8, the current storage and duplicating apparatuses 214*a*–214*n* execute the current storage function during the time periods Ta, Tb–Tn, respectively, and the driving function of the OLEDs 212*a*–212*n* corresponding thereto keeps going.

Figure 9:
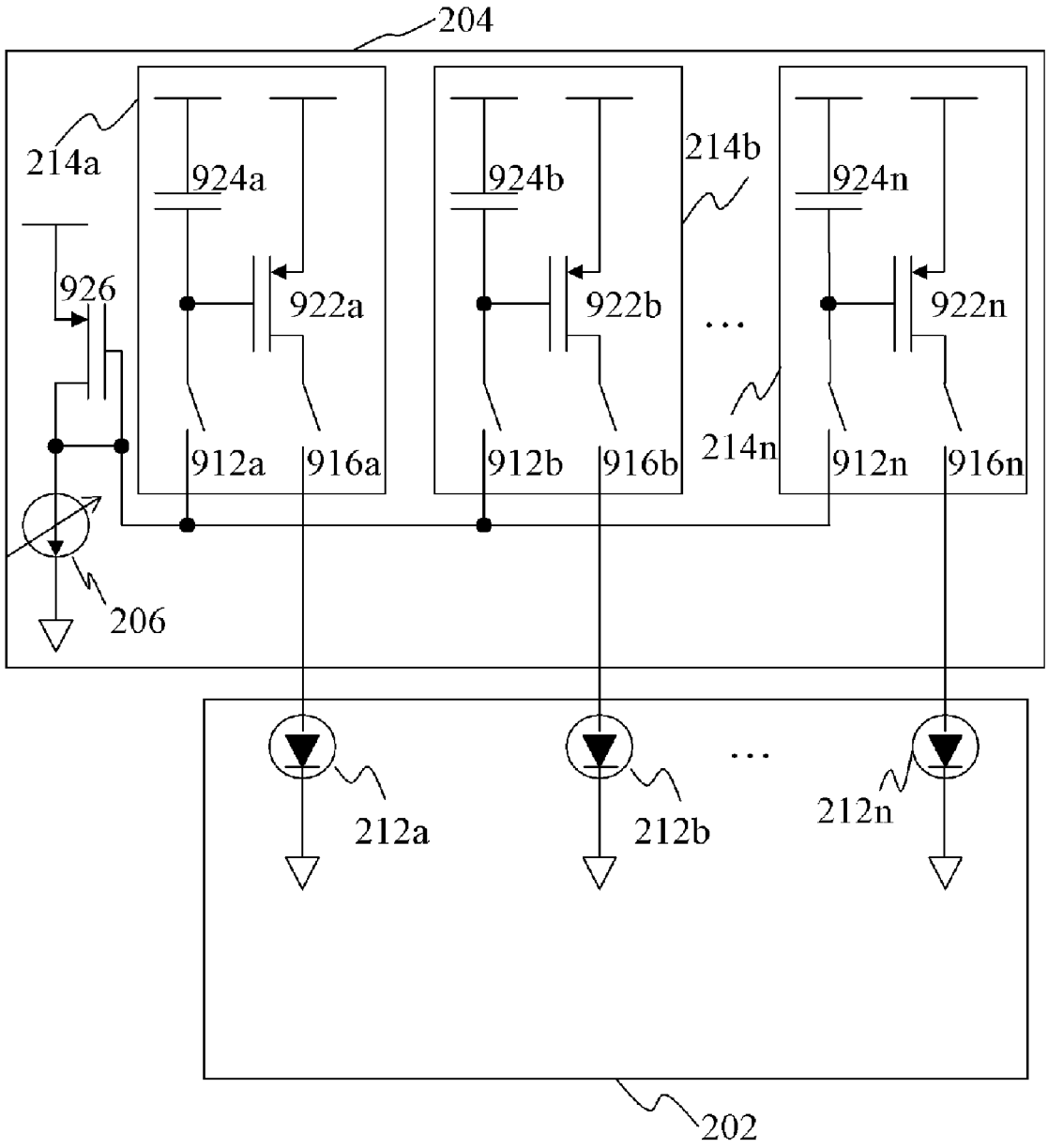
FIG. 9 is a schematic drawing showing a driving apparatus of an OLED according to an embodiment of the present invention.

FIG. 9 is a schematic drawing showing a driving apparatus of an OLED display according to an embodiment of the present invention. The OLED display 900 in FIG. 9 is similar to the OLED display 200 in FIG. 2. What is different is in the driving apparatus 204 and the structure of the current storage and duplicating apparatuses 214*a*–214*n*. In FIG. 9, the current storage and duplicating apparatus 214*a* comprises, for example, switches 912*a* and 916*a;* a transistor 922*a*, and a capacitor 924*a*. Wherein, a terminal of the switch 912*a* is coupled to the gate of the transistor 926, and another terminal of the switch 912*a* is coupled to the gate of the transistor 922*a*, and the capacitor 924*a*. A terminal of the switch 916*a* is coupled to the OLED 212*a*. Another terminal of the switch 916*a* is coupled to the drain of the transistor 922*a*. In addition, the structure of the current storage and duplicating apparatuses 214*b*–214*n* is similar to or same as that of the current storage and duplicating apparatus 214*a*. In addition to the current storage and duplicating apparatuses 214*a*–241*n*, the driving apparatus 204 further comprises a transistor 926. The gate of the transistor 926 is coupled to the switches 912*a*–912*n* of the current storage and duplicating apparatuses 214*a*–214*n*, and the drain of the transistor 926 is coupled to its gate and the controllable current source 206.

Referring to FIG. 9, in an embodiment of the present invention, when the transistor 926 and the current storage and duplicating apparatus 214*a* execute the current storage function, the controllable current source 206 generates a first current for the OLED 212*a*. The first current then flows from the source of the transistor 926 to the controllable current source 206. Because the gate and the drain of the transistor 926 are coupled, a voltage difference Vgs of the gate to the source is generated corresponding to the current of the controllable current source 206. Further, because the switch 912*a* is turned on, the voltage difference Vgs of the gate to the source is then stored in the capacitor 924*a* through the switch 912*a*. The current storage and duplicating apparatus 214*a* thus finishes the current storage function.

Referring to FIG. 9, in an embodiment of the present invention, the current storage and duplicating apparatus 214*a* executes the driving function, and the aspect ratio of the transistor 922*a* is M times of that of the transistor 926*a*. When the voltage difference Vgs of the gate to the source of the transistor 926 is stored in the capacitor 924*a*, once the switch 916*a* is turned on, the current output from the transistor 922*a* is M times of the first current.

Referring to FIG. 5, all switches are turned on in high voltages and turned off in low voltages. Waveforms of the switches 912*a*, 912*b*–912*n*, and 916*a*, 916*b*–916*n* are shown in FIG. 5. The current storage and duplicating apparatuses 214*a*–214*n* execute the current storage function during the time periods Ta–Tn, respectively. During other time periods, the current storage and duplicating apparatuses 214*a*–214*n* execute the driving function of the OLEDs 212*a*–212*n* corresponding thereto, respectively.

52 Referring to FIGS. 9 and 8, in an embodiment of the present invention, all of the switches 916*a*, 916*b*–916*n* are turned on during any time period. As a result, the current storage function of the current storage and duplicating apparatuses 214*a*–214*n*, and the driving function of the OLEDs 214*a*–214*n* corresponding thereto are simultaneously executed. As shown in FIG. 8, the current storage and duplicating apparatuses 214*a*–214*n* execute the current storage function during the time periods Ta, Tb–Tn, respectively, and the driving function of the OLEDs 212*a*–212*n* corresponding thereto keeps going.

In summary, each OLED over the panel corresponds to a current storage and duplicating apparatus. Thus, only one controllable current source of the driving apparatus is required. The amount of the controllable current sources can be effectively reduced. The advantages of the present invention at least include reducing the area and cost of the whole driving apparatus and avoid brightness errors occurred due to the reason that each of OLEDs uses a controllable current source different from each other in the prior art technology.

Although the present invention has been described in terms of exemplary embodiments, it is not limited thereto. Rather, the appended claims should be constructed broadly to include other variants and embodiments of the invention which may be made by those skilled in the field of this art without departing from the scope and range of equivalents of the invention.

What is claimed is:

1. A driving apparatus for driving a plurality of display devices of a panel, comprising:

a controllable current source; and a plurality of current storage and duplicating apparatuses, wherein each of the current and duplicating apparatuses is coupled to the controllable current source and a display device to receive a first current from the controllable current source, and to output a second current which is equal or proportional to the first current to drive the display device, wherein each of the current storage and duplicating apparatuses comprises:

a first switch;

a second switch;

a first transistor:

a second transistor; and a capacitor;

wherein a terminal of the first switch is coupled to the controllable current source, another terminal of the first switch is coupled to a gate of the first transistor, a gate and a drain of the second transistor, and the capacitor, wherein a terminal of the second switch is coupled to the display device, and another terminal of the second switch is coupled to a drain of the first transistor.

2. The driving apparatus of claim 1, wherein each of the current storage and duplicating apparatuses comprises:

a first switch;

a second switch;

a third switch;

a transistor; and a capacitor;

wherein a terminal of the first switch is coupled to the controllable current source, another terminal of the first switch is coupled to a terminal of the second switch, a terminal of the third switch, a drain of the transistor, and another terminal of the second switch is coupled to the transistor and a gate of the transistor, and another terminal of the third switch is coupled to the display device.

3. The driving apparatus of claim 1, wherein the display device comprises a light-emitting diode or an organic light-emitting diode.

4. A driving apparatus for driving a plurality of display devices of a panel, comprising:

a controllable current source; and a plurality of current storage and duplicating apparatuses, wherein each of the current and duplicating apparatuses is coupled to the controllable current source and a display device to receive a first current from the controllable current source, and to output a second current which is equal or proportional to the first current to drive the display device, wherein the driving apparatus further comprises a first transistor, a drain of the first transistor is coupled to a gate of the first transistor and the controllable current source, and each of the current storage and duplicating apparatuses comprises:

a first switch;

a second switch;

a second transistor; and a capacitor;

wherein a terminal of the first switch is coupled to a gate of the first transistor, another terminal of the first switch is coupled to a gate of the second transistor and the capacitor, a terminal of the second switch is coupled to the display device, and another terminal of the second switch is coupled to the drain of the second transistor.

5. A driving apparatus for driving a plurality of display devices of a panel, comprising:

a controllable current source; and a plurality of current storage and duplicating apparatuses wherein each of the current and duplicating apparatuses is coupled to the controllable current source and a display device to receive a first current from the controllable current source, and to output a second current which is equal or proportional to the first current to drive the display device, wherein the controllable current source comprises:

a constant current source;

a first transistor, wherein a gate and a drain of the first transistor are coupled to the constant current source;

a current mirror apparatus comprising a plurality of second transistors, wherein a gate of each of the second transistors is coupled to the gate of the first transistor; and a plurality of switches, wherein a terminal of each of the switches is individually coupled to a drain of one of the second transistors, and another terminal of each of the switches is coupled to an output terminal.

6. A driving method of a driving apparatus for driving a plurality of display devices of a panel, the driving apparatus comprising a controllable current source, and a plurality of current storage and duplicating apparatuses, wherein each of the current storage and duplicating apparatuses is individually coupled to the controllable current source and one of the display devices, the driving method comprising:

each of the current storage and duplicating apparatuses individually receives a first current from the controllable current source, and outputs a second current which is equal, or proportional to the first current to drive each of the display devices, wherein each of the current storage and duplicating apparatuses executes a current storage function during one of a plurality of time sequences, and executes a function of driving one of the display devices corresponding thereto during a time sequence different from, the time sequences of executing the current storage function, or executes a function of driving all the display devices on a same time sequence different from the time sequences of executing the current storage function.

7. The driving method of claim 6, wherein the display device comprises a light-emitting diode or an organic light-emitting diode.

8. A driving method of a driving apparatus for driving a plurality of display devices of a panel, the driving apparatus comprising a controllable current source, and a plurality of current storage and duplicating apparatuses, wherein each of the current storage and duplicating apparatuses is individually coupled to the controllable current source and one of the display devices, the driving method comprising:

each of the current storage and duplicating apparatuses individually receives a first current from the controllable current source, and outputs a second current which is equal, or proportional to the first current to drive each of the display devices, wherein each of the current storage and duplicating apparatuses individually executes a current storage function during one of a plurality of time sequences, and the current storage and duplicating apparatuses execute a function of driving all of the display devices after all of the current storage and duplicating apparatuses finish the current storage function.

9. A driving method of a driving apparatus for driving a plurality of display devices of a panel, the driving apparatus comprising a controllable current source, and a plurality of current storage and duplicating apparatuses, wherein each of the current storage and duplicating apparatuses is individually coupled to the controllable current source and one of the display devices, the driving method comprising:

each of the current storage and duplicating apparatuses individually receives a first current from the controllable current source, and outputs a second current which is equal, or proportional to the first current to drive each of the display devices, wherein each of the current storage and duplicating apparatuses comprises a first switch, a second switch, a third switch, a transistor, and a capacitor, wherein a terminal of the first switch is coupled to the controllable current source, another terminal of the first switch is coupled to a terminal of the second switch, a terminal of the third switch, and a drain of the transistor, another terminal of the second switch is coupled to a gate of the transistor, and another terminal of the third switch is coupled to the display device, the driving method comprising:

when a first current source storage and duplicating apparatus of the current storage and duplicating apparatuses executes a current storage function, the controllable current source generating a first current, the first switch and the second switch of the first current source storage and duplicating apparatus is turned on, a voltage difference of a gate to a source of the transistor is stored in the capacitor; and turning on the third switch, when the first current source storage and duplicating apparatus executes the driving function, the transistor generating a second current equal to the first current.

10. A driving method of a driving apparatus for driving a plurality of display devices of a panel, the driving apparatus comprising a controllable current source, and a plurality of current storage and duplicating apparatuses, wherein each of the current storage and duplicating apparatuses is individually coupled to the controllable current source and one of the display devices, the driving method comprising:

each of the current storage and duplicating apparatuses individually receives a first current from the controllable current source, and outputs a second current which is equal or proportional to the first current to drive each of the display devices, wherein each of the current storage and duplicating apparatuses comprises a first switch; a second switch; a first transistor; a second transistor; and a capacitor, wherein a terminal of the first switch is coupled to the controllable current source, another terminal of the first switch is coupled to a gate of the first transistor, a gate and a drain of the second transistor, and the capacitor, a terminal of the second switch is coupled to the display device, and another terminal of the second switch is coupled to a drain at the first transistor, the driving method comprising:

when a first current source storage and duplicating apparatus of the current storage and duplicating apparatuses executes the current storage function, the controllable current source generating a first current, the first switch of the first current source storage and duplicating apparatus is ruined on, a voltage difference of a gate to a source of the second transistor is stored in the capacitor; and turning on the second switch, when the first current source storage and duplicating apparatus executes the driving function, the first transistor generating a second current proportional to the first current, wherein a ratio of the second current to the first current is equal to a ratio of an aspect ratio of the second transistor to an aspect ratio of the first transistor.

11. The driving method of claim 10, further comprising:

turning on the second switches during any of the time sequences; the current storage function of the current storage and duplicating apparatuses, and the driving function of organic light-emitting diodes corresponding thereto are simultaneously executed.

12. A driving method of a driving apparatus for driving plurality of display devices of a panel, the driving apparatus comprising a controllable current source, and a plurality of current storage and duplicating apparatuses, wherein each of the current storage and duplicating apparatuses is individually coupled to the controllable current source and one of the display devices the driving method comprising:

each of the current storage and duplicating apparatuses individually receives a first current from the controllable current source, and outputs a second current which is equal or proportional to the first current to drive each of the display devices, wherein the driving apparatus further comprises a first transistor, a drain of the first transistor is coupled to a gate of the first transistor and the controllable current source, each of the current storage and duplicating apparatuses comprises a first switch; a second switch; a second transistor; and a capacitor, wherein a terminal of the first switch is coupled to a gate of the first transistor, another terminal of the first switch is coupled to a gate of the second transistor and the capacitor, a terminal of the second switch is coupled to the display device, and another terminal of the second switch is coupled to the drain of the second transistor, the driving method comprising:

when a first current source storage and duplicating apparatus of the current storage and duplicating apparatuses executes the current storage function, the controllable current source generating a first current, the first switch of the first current source storage and duplicating apparatus is turned on, a voltage difference of a gate to a source of the first transistor is stored in the capacitor; and turning on the second switch, when the first current source storage and duplicating apparatus executes the driving function, the first transistor generating a second current proportional to the first current, wherein a ratio of the second current to the first current is equal to a ratio of an aspect ratio of the second transistor to an aspect ratio of the first transistor.

13. The driving method of claim 12, further comprising:

turning on the second switches during any of the time sequences; the current storage function of the current storage and duplicating apparatuses, and the driving function of organic light-emitting diodes corresponding thereto are simultaneously executed.

* * * * *